US008640930B2

(12) United States Patent
Nunez et al.

(10) Patent No.: US 8,640,930 B2
(45) Date of Patent: Feb. 4, 2014

(54) VENT TUBE APPARATUS AND METHOD

(75) Inventors: Justin M. Nunez, East Troy, WI (US); David K. Osenga, Union Grove, WI (US)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 13/634,119

(22) PCT Filed: Mar. 10, 2011

(86) PCT No.: PCT/US2011/027939

§ 371 (c)(1), (2), (4) Date: Nov. 12, 2012

(87) PCT Pub. No.: WO2011/112835

PCT Pub. Date: Sep. 15, 2011

(65) Prior Publication Data

US 2013/0056082 A1 Mar. 7, 2013

Related U.S. Application Data

(60) Provisional application No. 61/312,945, filed on Mar. 11, 2010.

(51) Int. Cl.
*B67D 7/78* (2010.01)

(52) U.S. Cl.
USPC ..... 222/464.6; 222/1; 222/189.1; 222/464.4; 222/481.5

(58) Field of Classification Search
USPC ..... 222/109, 11, 189.1, 464.4, 464.6, 222/481.5, 111, 1
See application file for complete search history.

(56) References Cited

U.S. PATENT DOCUMENTS

| | | | | |
|---|---|---|---|---|
| 154,367 | A | | 8/1874 | Birgler |
| 291,285 | A | * | 1/1884 | Breese ..... 210/242.1 |
| 880,669 | A | * | 3/1908 | Keller ..... 222/481.5 |
| 1,054,146 | A | | 2/1913 | Smirle |
| 1,190,586 | A | * | 7/1916 | Robertson ..... 222/481.5 |
| 3,211,349 | A | * | 10/1965 | Prussin et al. ..... 222/402.18 |
| 3,456,647 | A | | 7/1969 | Wada |
| 3,495,622 | A | | 2/1970 | Rose |
| 3,584,770 | A | | 6/1971 | Taylor |
| 3,672,533 | A | | 6/1972 | McKean |
| 3,937,358 | A | | 2/1976 | Smith et al. |
| 3,968,897 | A | | 7/1976 | Rodgers |

(Continued)

FOREIGN PATENT DOCUMENTS

| | | |
|---|---|---|
| EP | 0557913 | 9/1993 |
| JP | 10114355 | 5/1998 |

(Continued)

*Primary Examiner* — Kevin P Shaver
*Assistant Examiner* — Nicholas J Weiss
(74) *Attorney, Agent, or Firm* — Michael Best & Friedrich LLP

(57) ABSTRACT

A venting apparatus for a liquid dispensing container adapted to hold a quantity of liquid having a liquid level within the liquid dispensing container. The venting apparatus includes a vent that has an aperture through which gas can exit the liquid dispensing container, a float, a liquid barrier carried by the float, and a flexible tube connecting the vent and the float. The flexible tube establishes fluid communication for gas through the vent and the liquid barrier between an interior space within the liquid dispensing container located above the liquid level and an exterior of the liquid dispensing container.

17 Claims, 4 Drawing Sheets

(56) References Cited

U.S. PATENT DOCUMENTS

| | | | | |
|---|---|---|---|---|
| 4,120,414 | A | | 10/1978 | Harrison et al. |
| 4,412,633 | A | | 11/1983 | Guerrazzi et al. |
| 4,722,463 | A | * | 2/1988 | Anderson ..... 222/185.1 |
| 4,923,098 | A | | 5/1990 | Schoonover et al. |
| 4,940,152 | A | | 7/1990 | Lin |
| 4,967,922 | A | | 11/1990 | Alder |
| 4,976,381 | A | | 12/1990 | Scholle et al. |
| 5,118,015 | A | | 6/1992 | Scholle et al. |
| 5,248,064 | A | | 9/1993 | Claycomb, Jr. |
| 5,433,346 | A | | 7/1995 | Howe |
| 5,460,285 | A | | 10/1995 | Harding, Sr. |
| 5,653,943 | A | | 8/1997 | Arnold |
| 5,887,766 | A | | 3/1999 | Yang |
| 5,901,867 | A | | 5/1999 | Mattson |
| 6,454,137 | B1 | | 9/2002 | Sturk |
| 6,619,499 | B1 | | 9/2003 | Lin |
| 6,732,877 | B2 | | 5/2004 | Wu et al. |
| 6,732,878 | B2 | | 5/2004 | Gillen |
| 6,833,072 | B1 | | 12/2004 | Krestine et al. |
| 7,086,548 | B2 | | 8/2006 | Bartlett |
| 7,201,287 | B2 | | 4/2007 | Maenke |
| 7,308,903 | B2 | | 12/2007 | Rooker et al. |
| 7,357,266 | B2 | | 4/2008 | Giblin et al. |
| 7,395,949 | B2 | | 7/2008 | Ehret et al. |
| 2004/0108340 | A1 | | 6/2004 | Witt |
| 2005/0145634 | A1 | | 7/2005 | Giblin et al. |
| 2007/0023461 | A1 | | 2/2007 | Christian et al. |
| 2007/0205230 | A1 | | 9/2007 | Arcuri et al. |
| 2007/0251913 | A1 | | 11/2007 | Mengeu |
| 2008/0110501 | A1 | | 5/2008 | Penno et al. |

FOREIGN PATENT DOCUMENTS

| | | |
|---|---|---|
| JP | 2008296981 | 12/2008 |
| KR | 1019990074986 | 10/1999 |
| KR | 20000000143 | 1/2000 |
| KR | 20040097087 | 11/2004 |
| WO | 9109244 | 6/1991 |

* cited by examiner

VENT TUBE APPARATUS AND METHOD

BACKGROUND

Liquid dispensing containers provide a convenient and cost effective way to dispense liquids, including liquid detergents, cleaning compositions, and other chemicals, many of which can be caustic or otherwise dangerous. One disadvantage of many liquid dispensing containers is that when they are exposed to high temperatures, the contents of the container can expand, such as by evaporation of the liquid contents, decomposition or reaction of the liquid contents (which can produce off-gassing and other pressure-increasing effects), and the like. These and other events can increase the risk that a container could leak its contents.

A cost effective way to vent pressure from the container is to provide an air valve in a dispensing cap of the container. However, in some orientations of a liquid dispensing container having such a valve, the dispensing cap is submerged under the liquid in the container. This is especially the case in liquid dispensing containers having little or no rigid structure, such as bag containers. In these and other cases, high pressure gas in the container may be unable to escape through the vent, and/or liquid in the container may leak out of the vent. Another disadvantage many air valves used for liquid containers is that elastomer components used in the valve can degrade and leak over time due to contact with contents of the container.

Based upon these and other limitations of conventional liquid container vents and dispensing containers having such vents, improved vents for liquid dispensing containers continue to be welcome in the art.

SUMMARY

In some embodiments of the present invention, a first end of a vent tube within a liquid dispensing container is coupled to a float also located within the container, and an opposite second end of the vent tube is coupled to a vent of the liquid dispensing container. The vent can be located in a dispensing cap of the liquid dispensing container, or can be located in another fitting of the liquid dispensing container. In either case, the float maintains the first end of the vent tube at a position at the top of liquid within the container, thereby maintaining fluid communication between an air or gas pocket inside the liquid dispensing container and the environment outside the liquid dispensing container. By virtue of the float, the vent tube maintains this fluid communication in multiple (and in some cases, all) orientations of the liquid dispensing container. In some embodiments, the floating vent tube apparatus is configured so that it cannot be obstructed by contacting a wall of the liquid dispensing container. Also, the floating vent tube apparatus can include a gas permeable/liquid impermeable membrane or other liquid barrier to substantially prevent liquid from escaping through the vent tube.

Some embodiments of the present invention provide a venting apparatus for a liquid dispensing container adapted to hold a quantity of liquid having a liquid level within the liquid dispensing container, wherein the venting apparatus comprises a vent having an aperture through which gas can exit the liquid dispensing container; a float; a liquid barrier carried by the float; and a flexible tube connecting the vent and the float, and establishing fluid communication for gas through the vent and liquid barrier between an exterior of the liquid dispensing container and an interior space within the liquid dispensing container located above the liquid level.

Some embodiments of the present invention provide a venting apparatus that includes a vent that has an aperture through which gas can exit the liquid dispensing container; a float; and a flexible tube coupled between the vent and the float. The flexible tube communicates gas from an interior space within the liquid dispensing container located above the liquid level through the vent, and the flexible tube is at least partially submerged and passes through the liquid supported within the liquid dispensing container.

Some embodiments of the present invention provide a venting apparatus for a liquid dispensing container that is adapted to hold a quantity of liquid having a liquid level within the liquid dispensing container and that defines an interior space above the liquid level. The venting apparatus includes a vent that has an aperture through which gas from the interior space can exit the liquid dispensing container; a float defining an aperture in fluid communication with the interior space of the liquid dispensing container; a flexible tube connecting the vent and the float, the flexible tube establishing fluid communication for gas to exit through the vent from the interior space to an exterior of the liquid dispensing container; and a gas permeable liquid barrier carried by the float to prevent liquid from entry into the flexible tube.

Some embodiments of the present invention provide a method of venting gas in a liquid dispensing container having a vent. The liquid dispensing container is adapted to hold a quantity of liquid having a liquid level within the liquid dispensing container and defines an interior space above the liquid level. The method includes fluidly communicating gas from the interior space to the vent through a flexible tube at least partially submerged in and passing through the liquid; floating an end of the flexible tube opposite the vent such that the flexible tube remains in fluid communication with the interior space in any orientation of the liquid dispensing container; venting gas from the interior space to an exterior of the liquid dispensing container while preventing blockage of the flexible tube by liquid in the liquid dispensing container; and further inhibiting liquid discharge from the liquid dispensing container through the flexible tube.

Other aspects of the present invention will become apparent by consideration of the description and accompanying drawings.

DRAWINGS

DETAILED DESCRIPTION

Before any embodiments of the present invention are explained in detail, it is to be understood that the invention is not limited in its application to the details of construction and the arrangement of components set forth in the following description or illustrated in the accompanying drawings.

Figure 1:
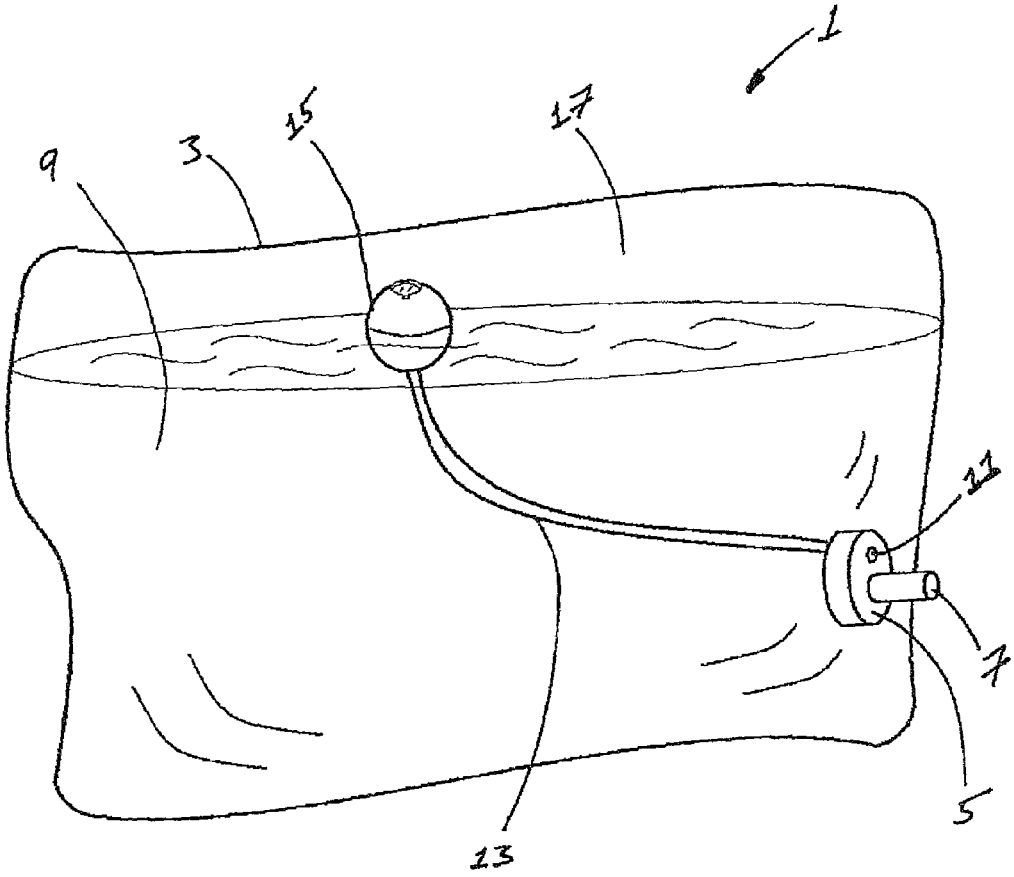
FIG. 1 is a perspective view of a liquid dispensing container according to an embodiment of the present invention.

FIG. 1 illustrates a liquid dispensing container 1 comprising a container 3 and a dispensing cap 5. The illustrated container 3 can have any other shape and size desired, and is constructed of a pliable material, such as (by way of example only) polyethylene or any other suitable type of plastic. In the illustrated embodiment of FIGS. 1-4, the container 3 has no rigid support retaining the container 3 in any particular orientation, and so can be particularly susceptible to rolling or otherwise moving to a number of different orientations. In other embodiments, the container 3 is retained within a box, frame, or other housing that can limit or prevent such movement, and/or can be constructed of a material having greater rigidity (e.g., a bottle, box, or other container).

Figure 2:
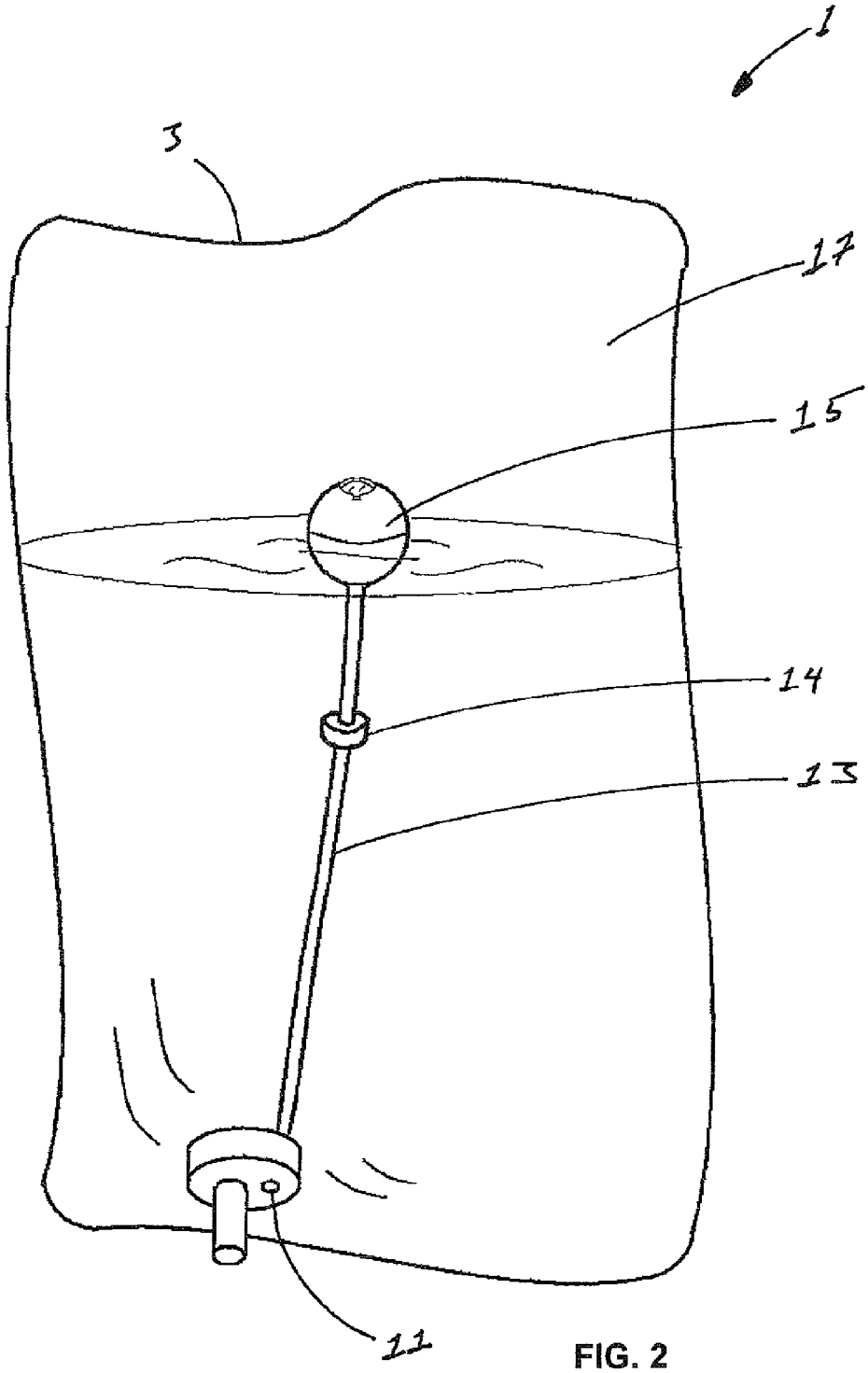
FIG. 2 is a perspective view of the liquid dispensing container of FIG. 1, shown rotated to a different orientation and with a first type of tube weight.
Figure 3:
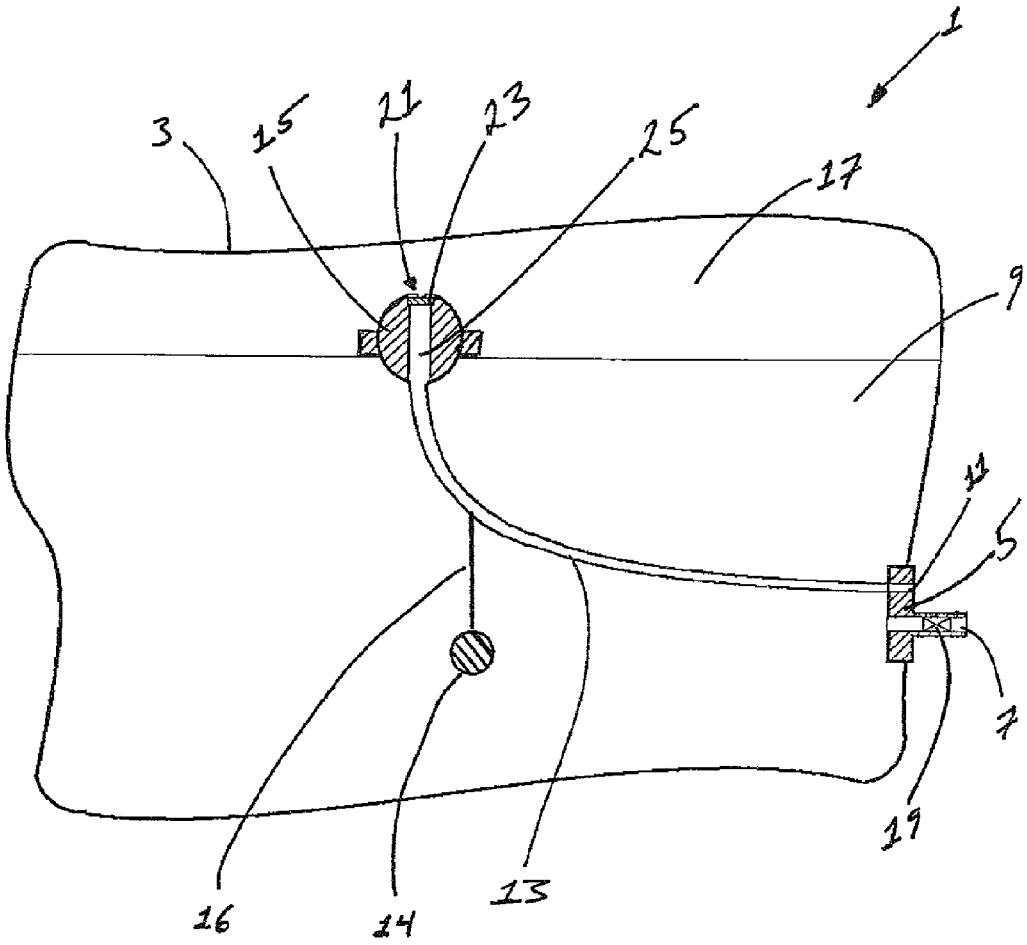
FIG. 3 is a cross-sectional side view of a liquid dispensing container according to another embodiment of the present invention and with a second type of tube weight.

The dispensing cap 5 shown in FIGS. 1-3 includes a valved passage 7 for dispensing liquid 9 from the container 3, and additionally includes a vent 11 for exhausting gas from a gas pocket 17 in the interior of the container 3 to the outside environment. As best shown in FIG. 3, the passage 7 has a valve 19 therein that can be manipulated by a user to open and close fluid flow through the dispensing cap 5. The valve 19 can take any form desired, including without limitation a ball valve, needle valve, butterfly valve, and the like.

With continued reference to FIGS. 1-5, the liquid dispensing container 1 also has a flexible vent tube 13 fluidly coupled to the vent 11 and located within the container 3. The vent tube 13 can be constructed of any material desired, such as plastic or rubber. The material can be selected based at least in part upon the material's compatibility with the contents of the container 3. The vent tube 13 can have any diameter capable of maintaining fluid communication between the gas pocket 17 and the vent 11, and can also have any length suitable for extending to and reaching the gas pocket 17 in at least one (and in some cases, all) orientations of the container 3.

The illustrated liquid dispensing container 1 also includes a float 15 coupled to an end of the vent tube 13 opposite the vent 11. The float 15 of the illustrated embodiment of FIGS. 1 and 2 is substantially spherical, although the float 15 can take any other shape desired. In some embodiments, the float 15 has a width that is substantially greater than the height of the float 15, thereby providing the float 15 with a lower profile than that shown in FIGS. 1 and 2. Such float shapes can provide additional stability to the float 15, thereby helping to prevent the float 15 from flipping even in relatively rapid orientation changes of the liquid dispensing container 1. One such float shape is shown by way of example only in FIG. 3, wherein the float 15 is substantially disc shaped with an enlarged central portion. In other embodiments, the float 15 can be disc shaped without an enlarged central portion, can have a relatively flat body with any shape viewed from above (e.g., star-shaped, diamond, shaped, round, elliptical, and the like). The float 15 can be constructed of any material that is less dense than the liquid contained within the container 3, and in some embodiments can have one or more empty or partially-empty internal chambers to enhance buoyancy of the float 15. Also, in some embodiments, the float 15 can be made up of multiple sections, or multiple floats 15 of the same or different size and shape can be provided within the liquid dispensing container 1, each of which can be attached to a corresponding vent tube 13, or which can be attached to a common vent tube 13. In the multiple float embodiments, some of the multiple floats 15 can be coupled to different portions of the same vent tube 13, whereas in other embodiments, two or more floats 15 can move (e.g., slide) along the vent tube 13.

The float 15 is shaped to hold the end of the vent tube 13 opposite the vent 11 in a location above the level of liquid within the container 3. To this end, the floats 15 illustrated in the embodiments of FIGS. 1-5 each receive an end of the vent tube 13 within an aperture in the float 15, or otherwise have an aperture therein that is in fluid communication with the interior of the vent tube 13 when the vent tube is attached to the float 15. The vent tube 13 in the illustrated embodiments is attached to a central location of the float 15, although vent tube attachment locations disposed a distance from the center of the float 15 (e.g., at the periphery of the float or on a side of the float) are possible. The central vent tube connection location shown in FIGS. 1-5 can provide additional stability to the vent tube 13 and float 15, and can help retain the float 15 and the end of the vent tube 13 connected thereto in a substantially upright orientation. Both of these features can help retain fluid communication between the air pocket 17 and the interior of the vent tube 13 in various orientations of the container 3.

In some embodiments, one or more weights 14 can be attached to the vent tube 13 and/or float 15 in order to help maintain the float 15 and the end of vent tube 13 connected thereto in a substantially upright orientation. Two such weights 14 are shown in FIGS. 2 and 3 by way of example only. The weight(s) 14 can have any suitable shape, and can be constructed of any material that is more dense than the liquid contained within the container 3. In the embodiment of FIG. 2, a weight 14 is attached directly to the vent tube 13. In such embodiments, the weight 14 can be attached around the vent tube 13 (e.g., as a collar), or can be attached in any other position on the vent tube 13. In the embodiment of FIG. 3, a weight 14 is coupled to the vent tube 13 via a string 16. In some embodiments, the weight(s) 14 can be positioned centrally below the float 15, or concentrically about an outer edge of the float 15. The weight(s) 14 can be coupled to move relative to the vent tube 13, such as a weight 14 that is slidable by a user or installer to different locations along the vent tube 13.

Fins or perforated disks (not shown) can be coupled to the vent tube 13 and/or to the float 15 to provide damping to movement of the vent tube 13 and/or float 15 within the container 3 during orientation changes of the liquid dispensing container 1.

In some embodiments, the vent tube 13 is connected to an aperture 25 located within the float 15 (see FIGS. 1-5). However, in other embodiments, the float 15 has no such aperture, and instead is secured to the vent tube 13 in any other suitable manner, such as by being secured to a side of the vent tube 13 using adhesive or cohesive bonding material, one or more fasteners or brackets, and the like. The float 15 can alternatively be connected to the vent tube 13 indirectly through another object, such as the weight 14.

The float 15 maintains fluid communication between the pocket 17 in the container 3 and the environment outside the container 3 via the vent tube 13. Therefore, excess gas pressure inside the container 3 is vented from the pocket 17 through the vent tube 13 and the vent 11 to the outside environment.

The floats 15 in the embodiments of FIGS. 1-5 each carry a liquid barrier 21 in a position blocking liquid from entry into the vent tube 13. By way of example only, in some embodiments, the liquid barrier 21 is or includes a gas permeable and liquid impermeable membrane 23, such as a Gor-Tex® (registered trademark of W.L. Gore & Associates) membrane. Any other liquid impermeable and gas permeable membrane or device can instead be used, and can be carried by the float 15. In the illustrated embodiments, the liquid barrier 21 is located on the float 15 in a position covering the aperture 25 leading to the vent tube 13, thereby preventing liquid from entering the float 15 and vent tube 13, while still permitting gas from the pocket 17 to do the same. In other embodiments, the liquid barrier 21 can be located at the end of the vent tube 13, can be located within the vent tube 13, or in any other location performing the same liquid barrier and gas passage functions just described.

In some embodiments, the liquid barrier 21 not only prevents blockage of the vent tube 13 by liquid (which could interfere with the ability of gas to exit the container 3 when necessary), but the liquid barrier 21 can also prevent liquid from leaking out of the container through the vent 11.

FIG. 2 illustrates the liquid dispenser 1 in a different orientation. In this orientation, the float 15 maintains fluid communication between the air pocket 17 in the container 3 and the environment outside the container 3 via the vent tube 13 and the vent 11.

Figures 4, 5:
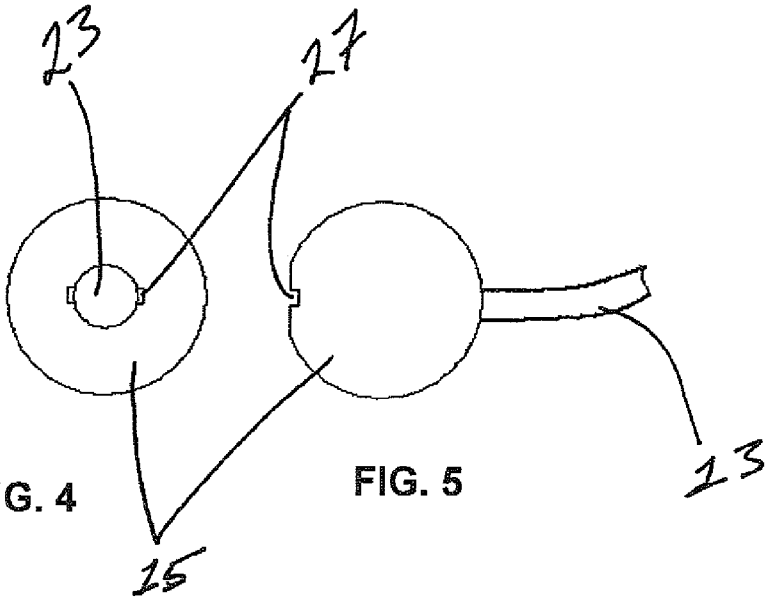
FIG. 4 is a top view of a float of the liquid dispensing container shown in FIGS. 1 and 2.
FIG. 5 is a side view of the float of the liquid dispensing container shown in FIGS. 1 and 2.

FIGS. 4 and 5 illustrate the float 15 of FIGS. 1 and 2 in greater detail, including the gas permeable and liquid impermeable barrier 21. In some embodiments, the float is provided with one or more apertures (e.g., channels, grooves, and the like) extending from an exterior surface of the float 15 to an aperture 25 of the float 15 leading to the vent tube 13. An example of such apertures 27 is shown in FIGS. 4 and 5. Any number of such apertures can exist in the float 15, and can help prevent the liquid impermeable barrier 21 from becoming blocked by a wall of the container 3 in some positions of the float 15 and orientations of the container 3.

The embodiments of the present invention described above and illustrated in the accompanying figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, the float 15 and vent tube 13 can take a number of other forms including various lengths, various shapes, and various materials. Also, a floating vent tube 13 or a partially floating vent tube 13 can be used instead of or in addition to the float 15 and the vent tube 13. In such embodiments, the floating vent tube 13 can be fitted with a gas permeable and liquid impermeable barrier 21. In addition, the vent 11 need not necessarily be located in a dispensing cap 5 of the liquid dispensing container 1, and can instead be located in any other structure of the liquid dispensing container 1. Accordingly, the vent tube 13 can extend and be connected to vents 11 in other locations as alternatives to the dispensing cap 5. In still other embodiments, the vent tube 13 can be made of a gas permeable/liquid impermeable material capable of at least partially performing the functions of the liquid impermeable barrier 21 described above.

Various features of the invention are set forth in the following claims.

What is claimed is:

1. A venting apparatus for a liquid dispensing container adapted to hold a quantity of liquid having a liquid level within the liquid dispensing container, the venting apparatus comprising:

a vent having an aperture through which gas can exit the liquid dispensing container;

a float;

a liquid barrier carried by the float;

a flexible tube connecting the vent and the float, the flexible tube establishing fluid communication for gas through the vent and the liquid barrier between an interior space within the liquid dispensing container located above the liquid level and an exterior of the liquid dispensing container; and a weight coupled to the float to urge the float toward at least one orientation above the liquid level to vent gas from the liquid dispensing container.

2. The venting apparatus of claim 1, wherein the vent is disposed in a dispensing cap of the liquid dispensing container.

3. The venting apparatus of claim 1, wherein the liquid barrier prevents liquid from entry into the flexible tube.

4. The venting apparatus of claim 1, wherein the float defines an aperture in fluid communication with an interior of the flexible tube to maintain fluid communication between the interior space and the vent.

5. A venting apparatus for a liquid dispensing container adapted to hold a quantity of liquid having a liquid level within the liquid dispensing container, the venting apparatus comprising:

a vent having an aperture through which gas can exit the liquid dispensing container;

a float having a first aperture in fluid communication with the interior space of the liquid dispensing container, and a second aperture extending from an exterior surface of the float to the first aperture to communicate gas from the interior space to the flexible tube; and a flexible tube coupled between the vent and the float and in communication with the first aperture, the flexible tube communicating gas from an interior space within the liquid dispensing container located above the liquid level through the vent and to an exterior of the container, the flexible tube at least partially submerged and passing through the liquid supported within the liquid dispensing container.

6. The venting apparatus of claim 5, wherein the float further includes a gas permeable liquid barrier preventing entry into the flexible tube.

7. The venting apparatus of claim 5, further comprising a weight coupled to one of the float and the flexible tube to urge the float toward at least one orientation.

8. The venting apparatus of claim 7, wherein the weight at least partially surrounds one of the float and the flexible tube.

9. The venting apparatus of claim 5, wherein the vent is disposed in a dispensing cap of the liquid dispensing container.

10. A venting apparatus for a liquid dispensing container adapted to hold a quantity of liquid having a liquid level within the liquid dispensing container and defining an interior space above the liquid level, the venting apparatus comprising:

a vent having an aperture through which gas from the interior space can exit the liquid dispensing container;

a float defining a first aperture in fluid communication with the interior space in the liquid dispensing container, and a second aperture extending from an exterior surface of the float to the first aperture to communicate gas from the interior space to the flexible tube;

a flexible tube connecting the vent and the float and in communication with the first aperture, the flexible tube establishing fluid communication for gas to exit through the vent from the interior space to an exterior of the liquid dispensing container; and a gas permeable liquid barrier carried by the float to prevent liquid entry into the flexible tube.

11. The venting apparatus of claim 10, wherein the liquid barrier is gas permeable and prevents blockage of the flexible tube by liquid in the liquid dispensing container.

12. The venting apparatus of claim 10, further comprising a weight coupled to one of the float and the flexible tube to urge the float toward at least one orientation.

13. The venting apparatus of claim 10, wherein the liquid barrier includes one of a valve and a membrane.

14. The venting apparatus of claim 10, wherein the vent is disposed in a dispensing cap of the liquid dispensing container.

15. The venting apparatus of claim 9, wherein the float has a width that is substantially greater than a height of the float.

16. The venting apparatus of claim 12, wherein the weight at least partially surrounds one of the float and the flexible tube.

17. A method of venting gas in a liquid dispensing container having a vent, the liquid dispensing container adapted to hold a quantity of liquid having a liquid level within the liquid dispensing container and defining an interior space above the liquid level, the method comprising:

fluidly communicating gas from the interior space to the vent through a flexible tube at least partially submerged in and passing through the liquid;

floating an end of the flexible tube opposite the vent such that an interior of the flexible tube remains in fluid communication with the interior space of the liquid dispensing container;

urging the end of the flexible tube toward at least one orientation above the liquid level to vent qas from the liquid dispensing container via a weight;

venting gas from the interior space to an exterior of the liquid dispensing container through the flexible tube while preventing blockage of the flexible tube by liquid in the liquid dispensing container; and inhibiting liquid discharge from the liquid dispensing container through the flexible tube.

* * * * *